United States Patent [19]

Guan et al.

[11] Patent Number: 5,013,912

[45] Date of Patent: May 7, 1991

[54] GENERAL PHASE MODULATION METHOD FOR STORED WAVEFORM INVERSE FOURIER TRANSFORM EXCITATION FOR FOURIER TRANSFORM ION CYCLOTRON RESONANCE MASS SPECTROMETRY

[75] Inventors: Shenheng Guan; Patrick R. Jones, both of Stockton, Calif.

[73] Assignee: University of the Pacific, Stockton, Calif.

[21] Appl. No.: 380,849

[22] Filed: Jul. 14, 1989

[51] Int. Cl.[5] ..... H01J 49/26

[52] U.S. Cl. ..... 250/282; 250/290; 250/291

[58] Field of Search ..... 250/282, 290, 291, 292

[56] References Cited

U.S. PATENT DOCUMENTS

| | | | |
|---|---|---|---|
| 3,932,955 | 2/1976 | Lomisarow et al. | 250/291 |
| 4,535,235 | 8/1985 | McIver, Jr. | 250/291 |
| 4,686,362 | 8/1982 | Louris et al. | 250/282 |
| 4,686,365 | 8/1987 | Meek et al. | 250/290 |
| 4,755,670 | 7/1988 | Syka et al. | 250/282 |
| 4,761,545 | 8/1988 | Marshall et al. | 250/282 |
| 4,855,593 | 8/1989 | Bodenhausen et al. | 250/282 |
| 4,945,234 | 7/1990 | Goodman et al. | 250/291 |

OTHER PUBLICATIONS

"Phase Modulated Stored Waveform Inverse Fourier Transform Excitation for Trapped Ion Mass Spectrometry", Ling Chen, et al., Amer. Chem. Soc. Anal. Chem., 1987, 59, pp. 449-454.

"Tailored Excitation for Trapped Ion Mass Spectrometry", A. G. Marshall, et al., *Chemical Abstracts,* 109:20992f, 1988.

"A New Method for Generating Swift Waveforms for FTMS", S. D. Goodman, Abstracts of 37th ASMS Conference on mass Spectrometry and Allied Topics, 1989.

"Tailored Excitation for Fourier Transform Ion Cyclotron Resonance Mass Spectrometry", A. G. Marshall et al., J. Am. Chem. Soc., 1985, 107, p. 7893.

"Effect of Time-Domain Dynamic Range on Stored Waveform Excitation for Fourier Transform Ion Cyclotron Resonance Mass Spectrometry", Ling Chen, et al., Rapid Communications in Mass Spectrometry, vol. 1, 1987.

"New Excitation and Detection Techniques in Fourier Transform Ion Cyclotron Resonance Mass Spectrometry", A. G. Marshall et al., Fourier Transform Mass Spectrometry-Evoluation, Innovation, and Applications, Chap. 2, 1987.

*Primary Examiner*—Jack I. Berman
*Assistant Examiner*—Kiet T. Nguyen
*Attorney, Agent, or Firm*—Townsend and Townsend

[57] ABSTRACT

A method for reducing the dynamic range of FT-ICR signal generated by the SWIFT technique includes the step of time shifting wave packets corresponding to segments of the Fourier spectral magnitude function to prevent coherent summing of the various frequency components of the excitation signal.

5 Claims, 3 Drawing Sheets

GENERAL PHASE MODULATION METHOD FOR STORED WAVEFORM INVERSE FOURIER TRANSFORM EXCITATION FOR FOURIER TRANSFORM ION CYCLOTRON RESONANCE MASS SPECTROMETRY

BACKGROUND OF THE INVENTION

Fourier transform ion cyclotron resonance (FT-ICR) mass spectrometry has become one of the most powerful techniques for mass analysis and for the study of ion-molecule reactions.

A particularly useful technique is the Stored Waveform Inverse Fourier Transform (SWIFT) technique. In a SWIFT excitation experiment, the magnitude spectrum is specified by the user. A phase function is selected and the magnitude and phase functions are subjected to inverse Fourier transformation to produce the excitation waveform, which is then stored in a buffer memory. The stored digital waveform data are clocked out and these digital amplitudes are converted to an analog time domain analog excitation signal, amplified, and applied to the excitation plates of an FT-ICR cell. A particular frequency component of the excitation signal excites only those ions having a particular m/z ratio corresponding to the particular frequency component. Thus, by controlling the frequency and amplitude of the Fourier magnitudes included in the excitation signal, selected ions may be excited or ejected from the FT-ICR cell.

A major problem with the SWIFT technique has been the large excitation signal amplitude at the start of the excitation signal (t=0) attributed to the coherent summing of the various frequency components. This large signal amplitude often exceeds the dynamic range of the driver amplifier and is clipped thereby introducing spurious frequency components into the excitation signal and reducing the effectiveness of the SWIFT technique. Further, large digital amplitudes requires longer word length in the hardware, such as the analog to digital converter, for storing, transferring, and processing the time-domain data.

Various techniques have been developed to break the phase coherence at t=0. One technique is phase randomization. However, although this technique reduces the dynamic range of the excitation signal, phase discontinuity may cause the non-uniform excitation power observed between the specified inverse Fourier transform intervals in the resulting excitation signal. A second technique found useful for a uniform magnitude spectrum is a quadratic phase modulation technique. However, this is not a general method.

However, no effective phase function has previously been found to reduce the dynamic range of an excitation signal derived from a generalized magnitude spectrum.

SUMMARY OF THE INVENTION

The present invention is a method for utilizing the SWIFT technique that minimizes the dynamic range of the excitation signal. This method provides a general solution for the problem of dynamic range reduction.

According to one aspect of the invention, the desired magnitude spectrum is specified by the user. The selected magnitude function is then partitioned into segments defined by a series of grid frequencies. The wave packets corresponding to the different segments are time shifted so that the peaks of the wave segments do not sum coherently to form a large peak signal amplitude. The reduction in dynamic range is about equal to the reciprocal of the number of segments formed.

According to a further aspect of the invention, each segment has an associated linear phase function, where the slope of the linear segment of the phase function is equal to the time shift for the wave packet corresponding to the segment.

According to a further aspect of the invention, the value of the phase function at the boundary of the segments are equal. This provides a continuous phase function.

Other features and advantages of the invention will be apparent in view of the appended drawings and following detailed description.

DETAILED DESCRIPTION OF THE PREFERRED EMBODIMENTS

Figure 1:
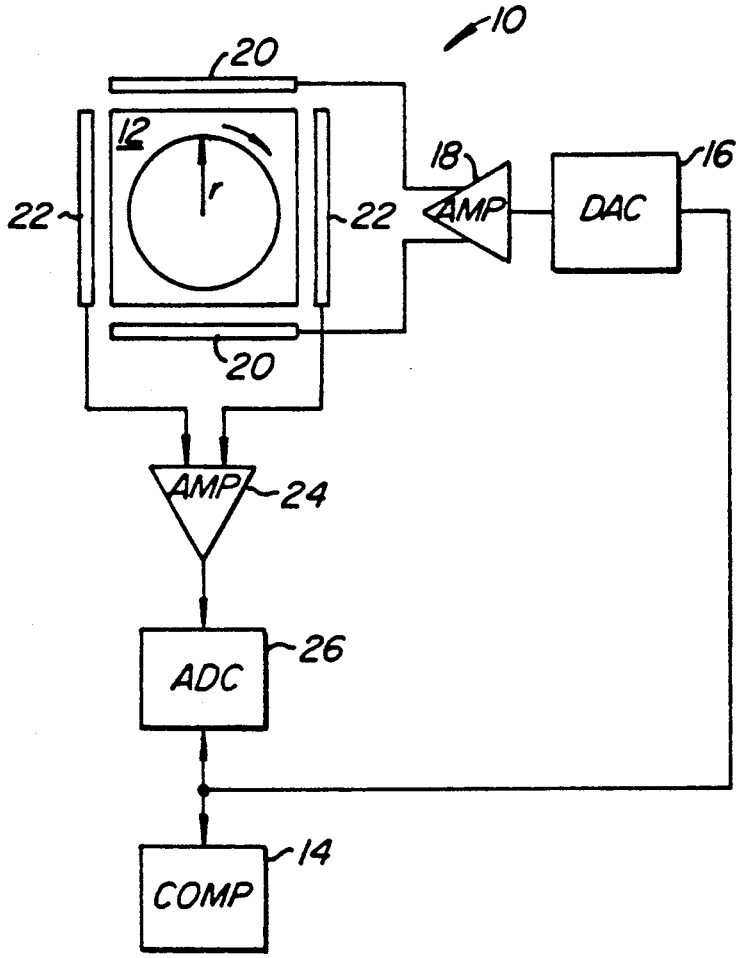
FIG. 1. PRIOR ART
FIG. 1 is a schematic diagram of a typical FT-ICR apparatus; using SWIFT excitation

FIG. 1 depicts a typical FT-ICR apparatus 10. An evacuated cell 12 includes the ions of interest and is immersed in a magnetic field directed perpendicular to the figure. The analog excitation signal is fed through a driver amplifier 18 and applied to excitation plates 20. A response signal is induced on the receiver plates 22 by the resonating ions, fed through a signal amplifier 24, converted to digital values by an analog to digital converter (ADC), and the digital response values are stored in the computer memory.

The resonant frequency of a particular ion is determined by its m/z ratio. Thus, if only selected ions are to be excited, the time domain excitation signal ideally would include only frequency components corresponding to the m/z ratios of the selected ions. In other applications, it may be desirable to eject selected ions. The cyclotron radius, r, of a particular ion depends on the magnitude of the corresponding frequency component in the excitation signal. Thus, if the magnitude of the frequency components for exciting the selected ions is sufficiently large then the cyclotron radius of the selected ions is sufficiently large and the selected ions are ejected from the cell 12.

The availability of high speed digital computers and hardware facilitate controlling the frequency spectrum of the excitation signal by specifying the magnitudes of the inverse Fourier frequency components at selected inverse Fourier intervals. For a given set of frequencies $\omega(n)$ having corresponding Fourier magnitudes F(n), the time domain signal is given by:

$$E(t) = \sum_n 2F(n)\cos[\omega(n)t + P(n)] \quad \text{Eq. 1}$$

In most situations the phase function, P(n), has no physical or chemical significance and is set to zero. However, for a zero phase function, at t=0 every phase component is equal to one and the frequencies sum coherently so that, at t=0:

$$E(t = 0) = \sum_n F(n). \quad \text{Eq. 2}$$

Figure 2:
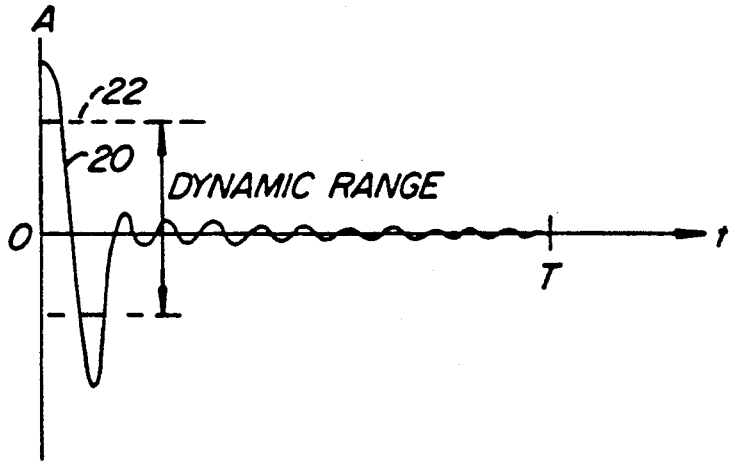
FIG. 2 is a graph of a time domain FT-ICR excitation signal.

An exemplary time domain excitation signal is depicted in FIG. 2. Note that if the amplitude of the signal 20 exceeds the dynamic range of the driver amplifier then the signal will be clipped as shown by the dotted lines 22. This clipping introduces spurious frequency components into the time domain excitation signal which reduces the effectiveness of the SWIFT technique.

A preferred embodiment of the present invention is a method for constructing a phase function for any predetermined Fourier spectral magnitude function that minimizes the dynamic range of the time domain excitation signal in a predicable manner.

Figure 3:
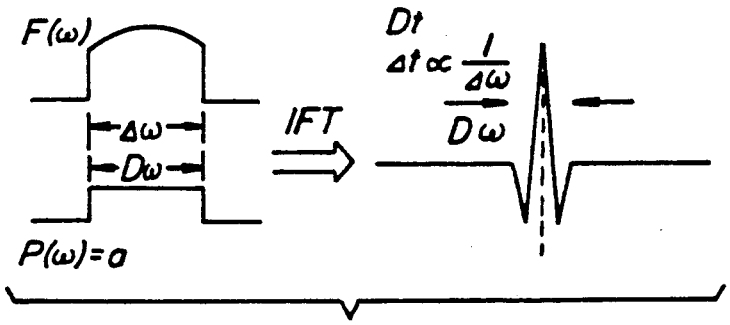
FIG. 3 is a graph illustrating the uncertainty principle of the Fourier transform.

The method utilizes two well-known properties of the Fourier transform. The first property, illustrated in FIG. 3, is the uncertainty principle of the Fourier transform which relates the width, Dt, of a time domain wave packet to the bandwidth, Dω, of the frequency domain spectral magnitude function according to the following equation:

$$DtD\omega = a \quad \text{Eq. 3}$$

where a is a constant reflecting the criterion for measuring Dt. For example, if Dt is measured at the point where the magnitude of the wave packet has decreased by a factor of 14 from its maximum magnitude then $a = 8\pi$.

Figure 4:
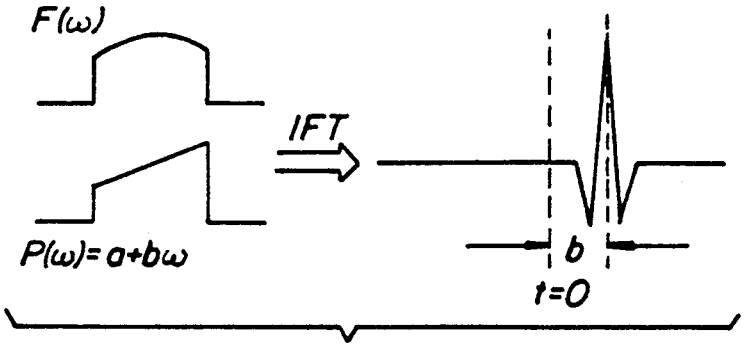
FIG. 4 is a graph illustrating the time shifting property of the Fourier transform.

The second property, illustrated in FIG. 4, is the time-shifting theorem where the location of a wave packet in the time domain may be time shifted by utilizing a linear phase function having a slope equal to the magnitude of the desired time shift.

Figure 5:
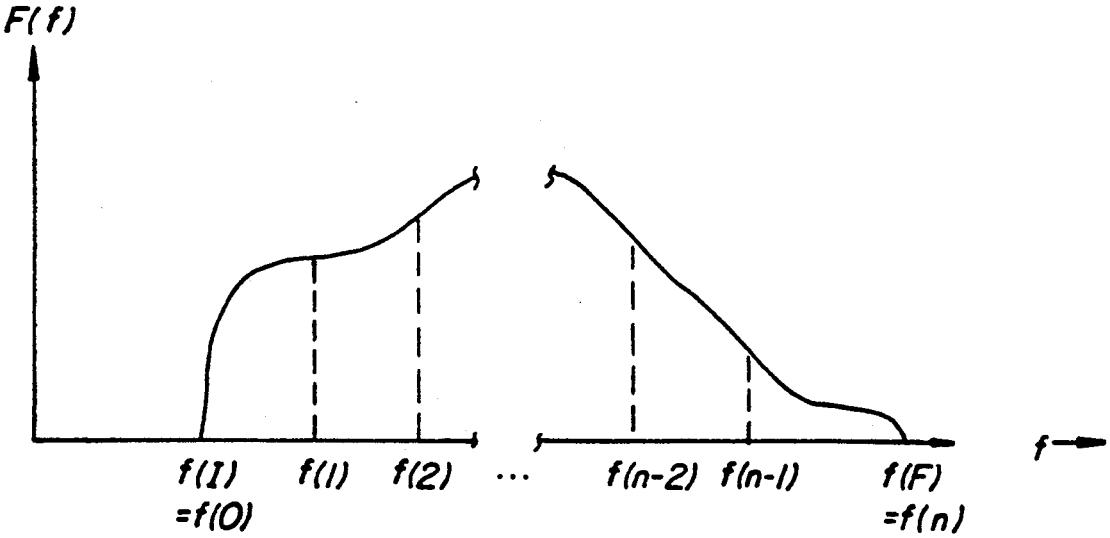
FIG. 5 is a graph of a segmented frequency domain Fourier spectral magnitude function.

The method of the invention will now be described with reference to FIGS. 5 and 6. In FIG. 5 a generalized Fourier magnitude spectral function defined over the frequency interval ω(I) to ω(N) is depicted. The spectral function has been divided into n segments by a frequency grid frequencies ω(i) where i=0 to n and ω(0)=ω(I) and ω(n)=ω(F). As described above, the time domain wave packets from each segment sum coherently at t=0 to generate a signal of large amplitude. If the wave packets corresponding to each segment could be distributed over a time interval from t=0 to t=T without overlapping then the magnitude of the time domain excitation signal at t=0 would be decreased by about a factor of 1/n.

Figure 6:
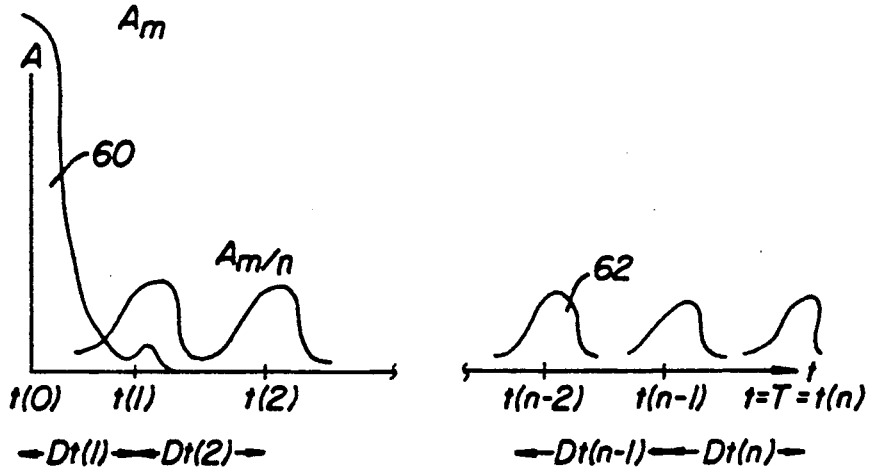
FIG. 6 is a graph of a time domain excitation signal formed according to the present invention.

FIG. 6 schematically depicts such a distributed time domain wave function. The wave function with a zero phase function 60 has a large peak of amplitude A at t=0. The various time shifted wave packets 62 are located at times t(k) which are separated by time intervals Dt(k) of sufficient width to prevent the wave packets from overlapping. The magnitude of a particular t(k) is given by the following formula:

$$t(k) = \sum_i Dt(i). \quad \text{Eq. 4}$$

The widths of each Dt(k) is equal to a/(Dω(k)) where Dω(k) is the frequency width of interval corresponding to wave packet k. The requirement that the wave packets not overlap limits the value of n because for larger n the wave packets spread out due to the uncertainty relationship of Eq. 3

As described above, the wave packet for the kth segment of the frequency magnitude spectral function can be placed at t(k) by selecting a phase function having a slope equal to t(k). The phase function for the frequency magnitude spectral function of FIG. 5 is depicted in FIG. 7.

The slope of the phase function for each frequency segment is equal to the time value where the wave packet corresponding to the segment is to be placed. Additionally, the phase function is made continuous by making the magnitudes of the phase function at the grid frequencies equal.

Figure 7:
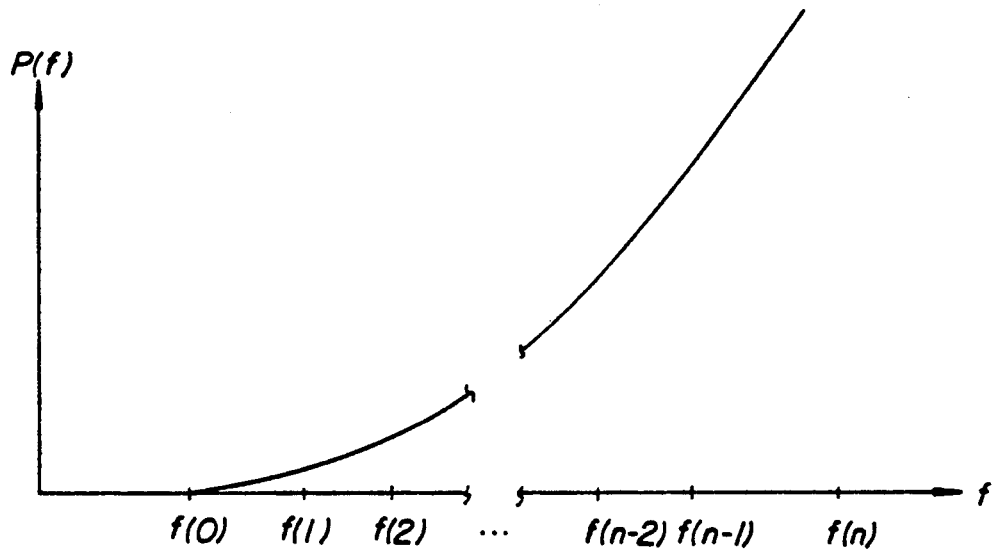
FIG. 7 is a graph of a frequency domain Fourier phase spectrum constructed according to the invention.

From FIG. 7, the phase function slope of the phase for any frequency in the kth frequency segment of FIG. 3 is:

$$t(k)\left[= \sum_k Dt(k) = P_k\right](f) - P_k(\omega(k))/]\omega - \omega(k). \quad \text{Eq. 5}$$

where ω(k) is equal to the lower limit grid frequency of the kth segment and is also equal to the upper limit grid frequency of the (k−1)th segment $P_k$ is the phase function for the kth segment. Phase function continuity is assured by setting:

$$P_{k-1}(\omega(k)) = P_k(\omega(k)) \quad \text{Eq. 6}$$

With this condition, the phase function for the kth segment is:

$$P_k(f) = P_{k-1}(\omega(k)) + t(k)(\omega - \omega(K)) \quad \text{Eq. 7}$$

The placement of the grid frequencies is limited by the uncertainty principle of Eq. 3, i.e., if the bandwidth of a particular segment is too small then the wave packet corresponding to the segment will be so wide that it overlaps the wave segments corresponding to other segments.

Figure 8:
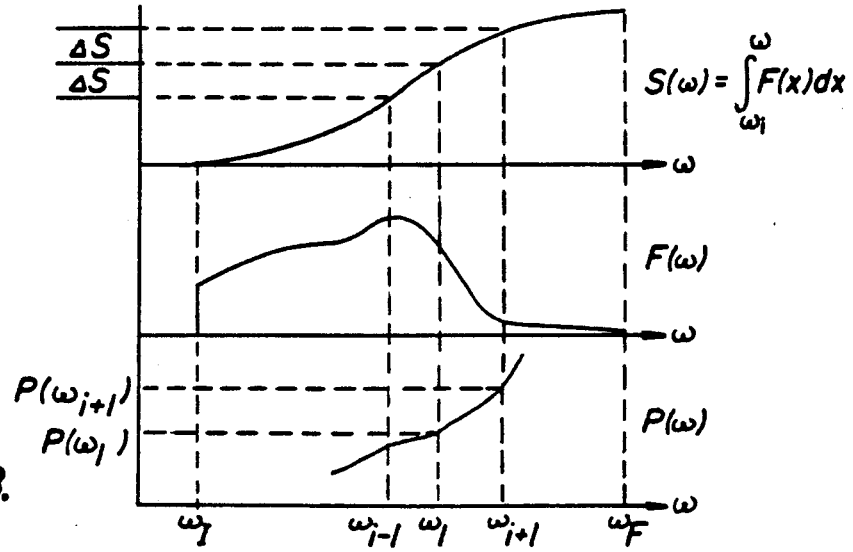
FIG. 8 is a graph illustrating an application of the present invention.

One approach to selecting the grid frequencies is illustrated in FIG. 8. The magnitude spectrum is divided into n segments of equal area. Note that, for an arbitrary spectrum, the grid frequency intervals are not necessarily equal. However, for a square magnitude spectrum equal area implies that the grid frequency intervals are equal to a constant (Dω). Thus, the domain of the magnitude spectrum, ω(F)−ω(I), is equal to nDω. If the width of each wave packet is Dt=a/Dω and the wave packets cover the time interval t=0 to t=T then T=nDt and:

$$n = (T(\omega(F) - \omega(I))/a)^{\frac{1}{2}} \quad \text{Eq. 8}$$

For a square magnitude spectrum with a 1 MHz bandwidth to be transmitted in a time duration of 2 ms. a dynamic range reduction of approximately a factor of 22 can be achieved.

The general relation describe by Eq. 7 may be applied to the square magnitude spectrum which is the excitation profile most commonly used in FT-ICR experiments. As described above, the square magnitude spectrum from $\omega(I)$ to $\omega(F)$ can divided with an equally space grid with intervals equal to $D\omega$ and the time distance T can be divided into intervals of Dt. Applying Eq. 7 to the upper limit frequency point $\omega(k+1)$ of the kth segment gives the following recurrence equation:

$$P(\omega(k+1))=P(\omega(k))+kDtD\omega \qquad \text{Eq. 9}$$

and if $P(\omega(I))$ is set to zero then:

$$P(\omega(k)) = D\omega Dt \sum_i i = DtD\omega k^2/2. \qquad \text{Eq. 10}$$

Using $\omega(k)=\omega(I)+kD\omega$, $nD\omega=\omega(F)-\omega(I)$, $nDt=T$ and dropping the index k, the phase function for the grid points is:

$$P(\omega)=(\omega-\omega(I))^2T/2(\omega(F)-\omega(I)) \qquad \text{Eq. 11.}$$

Although this relation is about the phase function at the grid points, the conclusion can be expanded to all the points on the frequency interval without introducing non-negligible error if the grid becomes sufficiently dense. Note that the phase function does not depend on the number n.

Thus, for a square magnitude spectrum the method of the invention results in quadratic phase modulation which has previously been discovered by trial and error by many investigators to be effective for reducing dynamic range for this type of profile.

What is claimed is:

1. A method for generating an FT-ICR excitation signal having reduced dynamic range over a given time duration comprising the steps of:

providing a desired excitation spectral magnitude function defined over a given frequency interval starting at a first frequency and ending at a second frequency;

dividing the desired excitation spectral magnitude function into a predetermined number of frequency segments of equal area;

utilizing the uncertainty principle of the Fourier transform to determine the approximate width, W, of the frequency segments in the time domain;

forming a phase function over said given frequency interval having a constant slope in each frequency segment, with the magnitude of the constant slope in a given frequency segment equal to n, with n being an integer indicating one more than the number of frequency segments disposed between the given frequency segment and said first frequency, multiplied by W;

performing the IFT of said desired excitation magnitude function and said defined phase function to generate an excitation function characterized by said desired excitation magnitude function having a dynamic range reduced by a factor about equal to said predetermined number and having nearly uniform excitation power over the time duration of the excitation signal and applying said excitation signal to excitation plates in an ion cyclotron resonance mass spectrometer.

2. A method for generating an FT-ICR excitation signal having reduced dynamic range over a given time duration comprising the steps of:

providing a desired excitation spectral magnitude function defined over a given frequency interval starting at a first frequency and ending at a second frequency;

dividing the desired excitation spectral magnitude function into a predetermined number of frequency segments;

utilizing the uncertainty principle of the Fourier transform to determine the approximate width, W, of the frequency segments in the time domain;

forming a phase function over said given frequency interval having a constant slope in each frequency segment, with the magnitude of the constant slope in a given frequency segment equal to n, with n being an integer indicating one more than the number of frequency segments disposed between the given frequency segment and said first frequency, multiplied by W;

performing the IFT of said desired excitation magnitude function and said defined phase function to generate an excitation function characterized by said desired excitation magnitude function having a dynamic range reduced by a factor about equal to said predetermined number and having nearly uniform excitation power over the time duration of the excitation signal and applying said excitation signal to excitation plates in an ion cyclotron resonance mass spectrometer.

3. A method for reducing the dynamic range of an analog FT-ICR excitation signal characterized by a desired spectral magnitude and defined over a time duration of selected length, said method comprising the steps of:

dividing the time duration into a first predetermined number of sequential subintervals;

forming said predetermined number of subintervals each characterized by a spectral magnitude function being a corresponding distinct segment of the desired spectral magnitude function characterizing the analog excitation signal;

shifting the position of each subinterval by multiple of a selected interval to generate a modified analog excitation signal characterized by a dynamic range reduced by a factor equal to about said first predetermined number.

4. The method of claim 3 further comprising:

selecting the magnitudes of the bandwidths of the corresponding spectral magnitude functions of adjacent wave packets so that said adjacent wave packets do not overlap.

5. The method of claim 1 or 2 wherein said step of forming includes the step of:

equalizing the magnitude of said phase function at the boundaries of said segments.

* * * * *